US010968560B2

(12) United States Patent
Park et al.

(10) Patent No.: US 10,968,560 B2
(45) Date of Patent: Apr. 6, 2021

(54) DRYER

(71) Applicant: Samsung Electronics Co., Ltd, Suwon-si (KR)

(72) Inventors: Ki Sun Park, Suwon-si (KR); Jin Woo So, Seongnam-si (KR); Myung Hee Ryu, Suwon-si (KR); Jin Woo Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/755,483

(22) PCT Filed: Aug. 10, 2016

(86) PCT No.: PCT/KR2016/008796
§ 371 (c)(1),
(2) Date: Feb. 26, 2018

(87) PCT Pub. No.: WO2017/034187
PCT Pub. Date: Mar. 2, 2017

(65) Prior Publication Data

US 2018/0251933 A1 Sep. 6, 2018

(30) Foreign Application Priority Data

Aug. 25, 2015 (KR) ..... 10-2015-0119301

(51) Int. Cl.
*D06F 58/24* (2006.01)
*D06F 58/02* (2006.01)
(Continued)

(52) U.S. Cl.
CPC ..... *D06F 58/24* (2013.01); *D06F 58/02* (2013.01); *D06F 58/206* (2013.01); *D06F 58/26* (2013.01); *D06F 58/20* (2013.01)

(58) Field of Classification Search
CPC ..... D06F 58/24; D06F 58/26; D06F 58/206; D06F 58/02; D06F 58/20
(Continued)

(56) References Cited

U.S. PATENT DOCUMENTS 9,238,886 B2 1/2016 Ryoo et al.
9,803,312 B2 10/2017 Chung et al.
(Continued)

FOREIGN PATENT DOCUMENTS

CN 101387072 A 3/2009
CN 102383296 A 3/2012
(Continued)

OTHER PUBLICATIONS

International Search Report dated Nov. 9, 2016 in connection with International Patent Application No. PCT/KR2016/008796.
(Continued)

*Primary Examiner* — Edelmira Bosques
*Assistant Examiner* — Bao D Nguyen

(57) ABSTRACT

A dryer according to the present disclosure may be a dryer to which a heat pump system is applied, and may provide a structure in which constant temperature external air is suctioned and supplied to a drum to maintain constant performance of the dryer. An air supply unit configured to supply hot dry air to the drum is isolated from an inside of the main body such that internal air including a foreign material is not introduced into the air supply unit, and a suction port cover is separably coupled to the dryer such that a foreign material introduced with the external air is easily removed.

18 Claims, 11 Drawing Sheets

(51) Int. Cl.
*D06F 58/20* (2006.01)
*D06F 58/26* (2006.01)

(58) Field of Classification Search
USPC ..... 34/75
See application file for complete search history.

(56) References Cited

U.S. PATENT DOCUMENTS

| | | | | |
|---|---|---|---|---|
| 9,879,372 | B2 | 1/2018 | Wakizaka et al. | |
| 2009/0071033 | A1 | 3/2009 | Ahn et al. | |
| 2010/0132216 | A1* | 6/2010 | Krausch | D06F 58/02 34/443 |
| 2012/0049705 | A1* | 3/2012 | Palazzin | D06F 58/02 312/236 |
| 2014/0137423 | A1 | 5/2014 | Chung et al. | |
| 2014/0144036 | A1* | 5/2014 | Caldeira | D06F 58/206 34/86 |
| 2014/0366397 | A1* | 12/2014 | Wakizaka | D06F 58/30 34/524 |

FOREIGN PATENT DOCUMENTS

| | | | |
|---|---|---|---|
| CN | 102822410 | A | 12/2012 |
| CN | 103835107 | A | 6/2014 |
| DE | 102010028441 | A1 | 11/2011 |
| EP | 2037034 | A2 | 3/2009 |
| EP | 2194182 | A1 | 6/2010 |
| EP | 2735639 | A2 | 5/2014 |
| JP | 2007-143711 | A | 6/2007 |
| KR | 10-2012-0014428 | A | 2/2012 |
| KR | 10-1210725 | B1 | 12/2012 |
| KR | 10-2014-0065265 | A | 5/2014 |
| KR | 10-2014-0147026 | A | 12/2014 |

OTHER PUBLICATIONS

Written Opinion of the International Searching Authority dated Nov. 9, 2016 in connection with International Patent Application No. PCT/KR2016/008796.

European Patent Office, "Supplementary European Search Report," Application No. EP 16839476.5, dated Jul. 10, 2018, 16 pages.

Office Action dated Nov. 20, 2019 in connection with Chinese Patent Application No. 201680049130.1, 17 pages.

Communication pursuant to Article 94(3) EPC dated Mar. 12, 2020 in connection with European Patent Application No. 16 839 476.5, 5 pages.

Office Action dated Jul. 10, 2020 in connection with Chinese Patent Application No. 201680049130.1, 16 pages.

Communication pursuant to Article 94(3) EPC dated Oct. 27, 2020 in connection with European Patent Application No. 16 839 476.5, 5 pages.

Office Action dated Oct. 15, 2020 in connection with India Patent Application No. 201817010599, 5 pages.

* cited by examiner

DRYER

CROSS-REFERENCE TO RELATED APPLICATION(S) AND CLAIM OF PRIORITY

The present application is a 371 National Stage of International Application No. PCT/KR2016/008796 filed Aug. 10, 2016, which claims priority to Korean Patent Application No. 10-2015-0119301 filed Aug. 25, 2015, the contents of which are incorporated herein by reference.

TECHNICAL FIELD

Embodiments of the present disclosure relate to a dryer configured to dry an object using a heat pump system or one or more electric heaters.

BACKGROUND

Generally, a dryer is an apparatus configured to dry an object to be dried in a drum by rotating the drum accommodating a wet object at a low speed and passing hot dry air through the drum. Clothes dryers configured to dry objects, which are completely washed wet laundry, are widely used as a general example of a dryer.

Dryers may be classified into electric dryers and gas dryers according to a method of heating air, that is, a power source. The electric dryer heats air using electric resistance heat, and the gas dryer heats air using heat generated by combusting a gas.

In addition, dryers are classified into discharging dryers and circulating dryers according to a method of processing moisture absorbed from an object to be dried.

A discharging dryer discharges moist air flowing from a drum to the outside via a discharge duct.

A condensing dryer uses a method of removing moisture of moist air, which flows from a drum, via a heat exchanger, and sending the air to the drum to circulate. Since the condensing dryer forms a closed loop airflow, it is difficult to use a gas as a heat source thereof, and maintenance costs are relatively high because electricity is mainly used. However, the condensing dryer has an advantage in that a discharge duct is not needed because air circulates between an object to be dried in the drum and a heat pump system.

However, in the case of the circulating dryer configured not to discharge air, since a condenser and an evaporator are installed in the dryer, a foreign material such as a particle present in the dryer or lint and the like generated while clothes are dried may be suctioned into a heat pump system, and thus efficiency of the dryer may be decreased. In this case, there are problems in that installation of a filter is essential, and, a temperature in the dryer is increased and air suctioned into the dryer is increased as a drying process is continuously performed, and thus drying efficiency of the dryer is decreased. In addition, there are problems in that a filter installation area is needed and cleaning is not easy.

SUMMARY

The present disclosure is directed to providing a dryer to which a heat pump system is applied capable of suctioning external air having a constant temperature, supplying the air to a drum, and discharging the air so that the dryer maintains a constant level of performance.

In addition, the present disclosure is directed to provide a dryer in which a condenser is disposed such that a foreign material accumulated in the dryer is not introduced into a condenser of a heat pump system installed in the dryer and cleaning is facilitated.

One aspect of the present invention provides a dryer including a main body, a drum installed in the main body, an air supply unit configured to supply air introduced from an outside of the main body into the drum, a discharge unit configured to suction air from the drum and discharge the air to the outside of the main body, and a heat pump system configured to exchange heat with air passing through the air supply unit, the drum, and the discharge unit, wherein the air supply unit is isolated from an inside of the main body such that the air in the main body is not introduced into the air supply unit.

Here, the heat pump system may include a condenser, an expander, an evaporator, and a compressor, the condenser is disposed in the air supply unit, and the evaporator may be disposed in the discharge unit.

In addition, the air supply unit may include a suction area into which air is introduced from the outside of the main body and an air supply area configured to supply the air to the drum, the suction area may be disposed below the drum, and the air supply area may be disposed behind the drum.

In addition, the suction area may include a suction port provided in at least one among a rear surface, a side surface, and a lower surface of the main body, and the air supply area may include an air supply port connected to a rear surface of the drum.

In addition, the condenser may be disposed in the suction area of the air supply unit.

In addition, the air supply unit may further include a heater configured to further heat air passing through the condenser.

In addition, the heater may be disposed in the air supply area of the air supply unit.

In addition, the discharge unit may include a discharge fan configured to discharge air from the drum, an evaporator configured to cool the air discharged from the drum by the discharge fan, and a discharge port through which the air passing through the evaporator is discharged to the outside of the main body.

Meanwhile, the air supply unit may be disposed behind the drum, and the discharge unit may be disposed below the drum.

Here, the air supply unit may include a suction port connected to a rear or side surface of the main body, and an air supply port connected to a rear surface of the drum.

Another aspect of the present invention provides a dryer including a main body having a base plate, a drum installed in the main body, a condenser seated on the base plate and configured to heat air introduced from the outside of the main body, an evaporator configured to cool air discharged from the drum, a compressor and an expander configured to form a refrigerant circuit together with the condenser and the evaporator, and a housing configured to accommodate the condenser such that the condenser is isolated from the inside of the main body, and the housing is coupled to the base plate.

In addition, the housing may be disposed adjacent to a side or rear surface of the main body, and the housing may include a suction port provided in the rear surface of the main body or one surface of the housing connected to the rear surface.

In addition, the housing may include a suction port cover detachably coupled to the suction port.

In addition, the dryer may further include an additional suction port provided in the base plate divided by the housing.

In addition, the housing may include an air supply port provided at one surface of the housing connected to a rear surface of the drum.

In addition, the dryer may further include a heater disposed in the housing to further heat air heated by the condenser.

Still another aspect of the present invention provides a dryer including a main body, a drum installed in the main body, a condenser configured to heat air introduced from an outside of the main body, an evaporator configured to cool air discharged from the drum, a compressor and an expander configured to form a refrigerant circuit together with the condenser and the evaporator, and a housing configured to accommodate the condenser and isolate the condenser from an inside of the main body such that air in the main body is not introduced into the condenser, wherein the housing may be disposed behind the drum.

Here the housing may include a suction port provided in one surface of the housing connected to a rear or side surface of the main body and an air supply port provided in the one surface of the housing connected to a rear surface of the drum.

In addition, the housing may include a suction port cover detachably coupled to the suction port.

In addition, the dryer may further include a heater disposed in the housing to further heat air heated by the condenser.

According to the present invention, since a dryer including a heat pump system is formed as a discharging dryer, performance of heat pump system can be constantly maintained by suctioning external air having a constant temperature. In addition, since an air supply unit is airtightly isolated from an inside of the dryer so that air in the dryer is not introduced into an air supply path in which a condenser of the heat pump system is disposed, a structure in which various foreign materials such as a particle and the like present in the dryer are not suctioned into the air supply unit even when a filter for preventing introduction of the foreign materials is not used and cleaning is facilitated in a case in which a foreign material is introduced together with external air can be provided.

DETAILED DESCRIPTION

Hereinafter, embodiments of the present disclosure will be described in detail with reference to the accompanying drawings.

Figure 1:
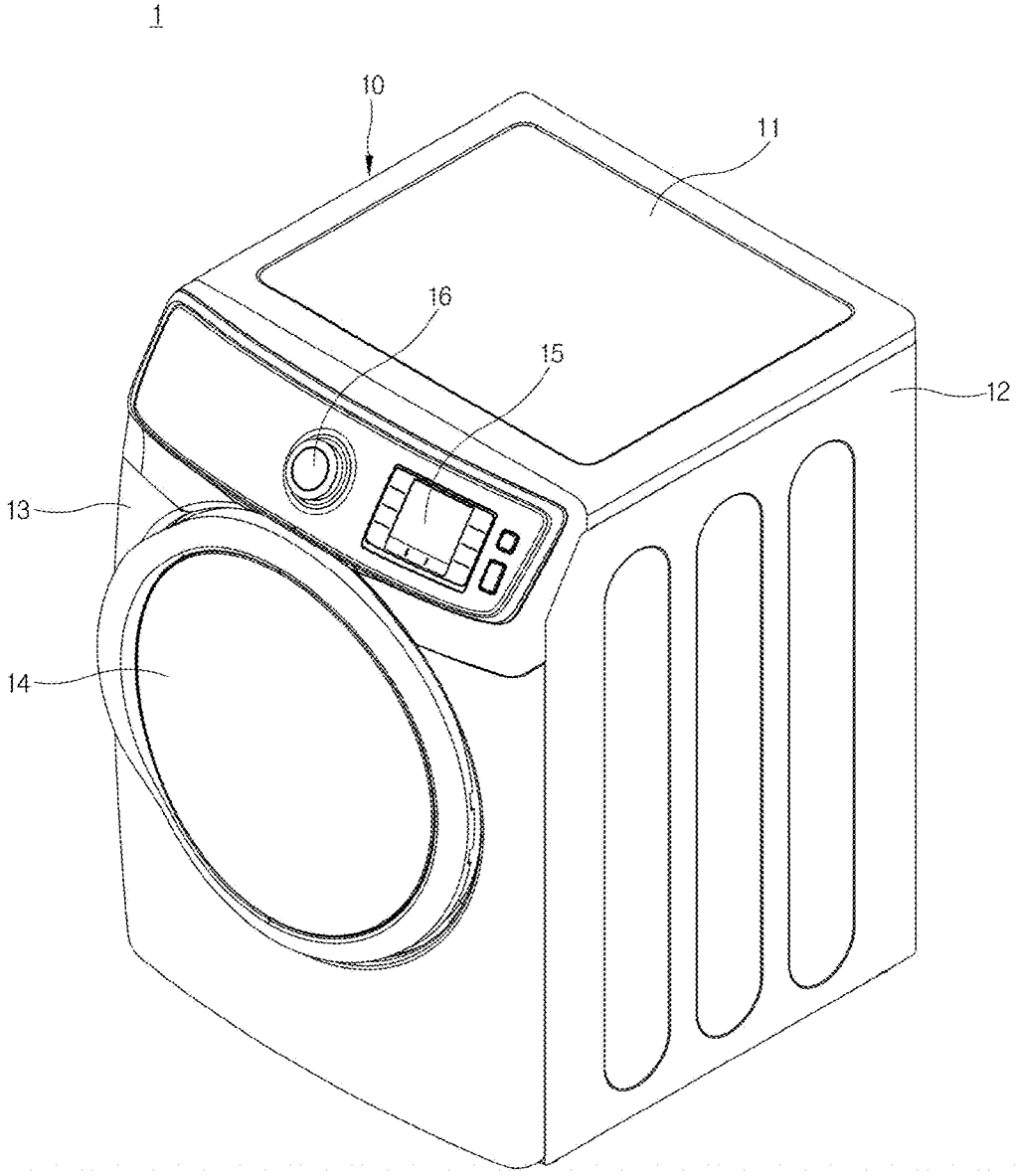
FIG. 1 is a perspective view illustrating a front exterior of a dryer according to an embodiment of the present disclosure.
Figure 2:
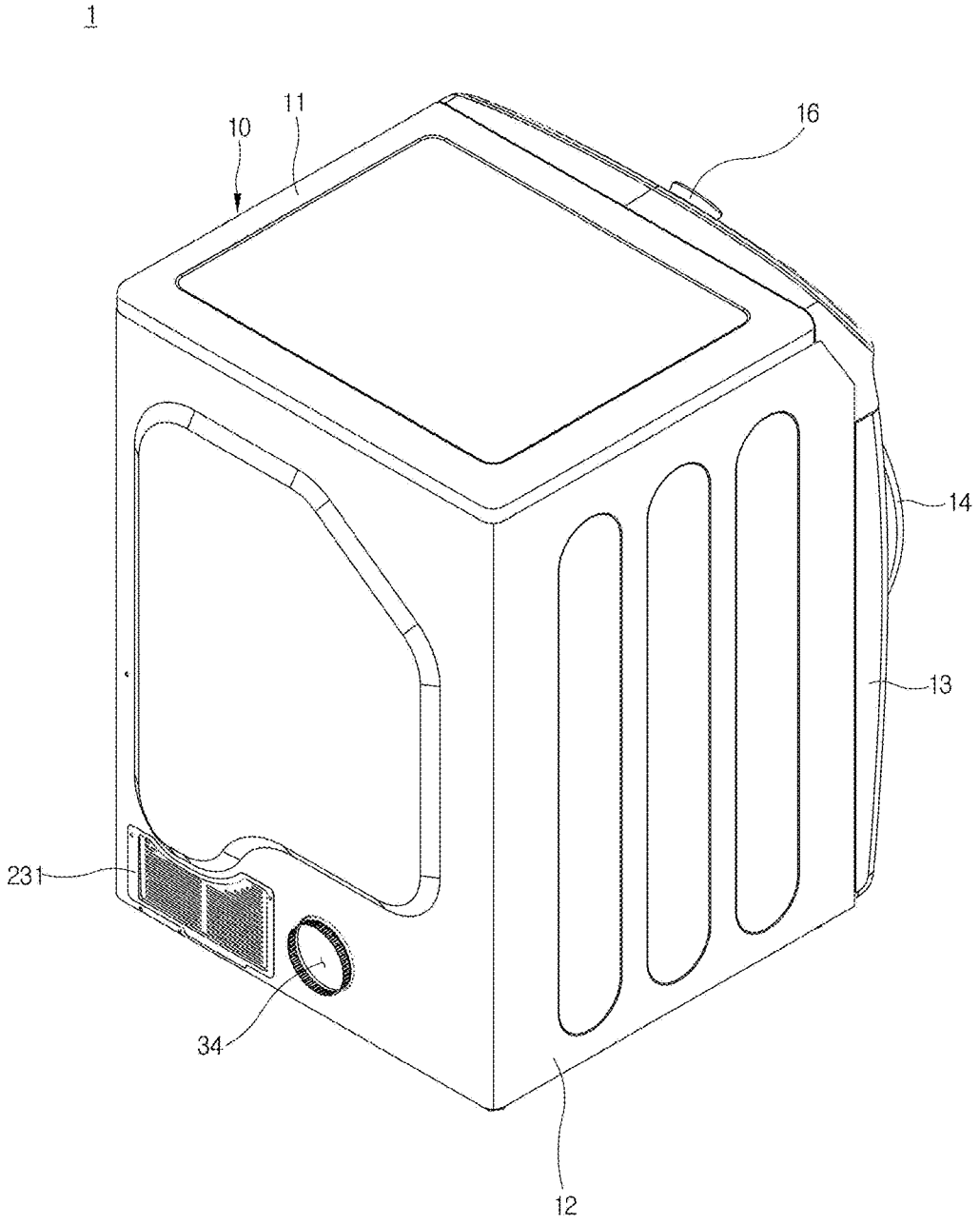
FIG. 2 is a perspective view illustrating a rear exterior of the dryer according to one embodiment of the present disclosure.

FIG. 1 is a perspective view illustrating a front exterior of a dryer according to an embodiment of the present disclosure, and FIG. 2 is a perspective view illustrating a rear exterior of the dryer according to one embodiment of the present disclosure.

As illustrated in FIG. 1, a dryer 1 may include a main body 10 configured to lengthily extend vertically and having a long rectangular shape in a height direction.

The main body 10 may include a top cover 11, a front cover 13, and a side and rear cover 12, and a display 15 and a rotary switch 16 for controlling the dryer 1 may be disposed on an upper end of the front cover 13. The rotary switch 16 may be provided such that a user grasps and rotates the rotary switch 16 to select a mode of the dryer 1. The display 15 may display an operation state of the dryer 1 and a manipulation state of the user.

An opening formed in a substantially circular shape seen from the front is provided in the front cover 13 of the main body 10, and the opening is opened and closed by a door 14 rotatably installed on the main body 10. A drum 40 (see FIG. 3) into which clothes, which are the objects to be dried, are input is rotatably installed in the main body 10. The inside of the drum 40 is connected to the opening so that an object to be dried is input into the drum 40 or a completely dried object is withdrawn from the drum 40 via the door 14 when the opening is opened by the door 14.

Referring to FIG. 2, a suction port 23 through which air for drying is suctioned and a discharge port 34 through which air used in drying is discharged may be provided in a rear surface of the dryer 1. A suction port cover 231 may be detachably provided on the suction port 23. In a case in which a foreign material is suctioned into the suction port 23, the suction port cover 231 may be separated from the suction port 23 and an inside of the suction port 23 may be cleaned.

Figure 3:
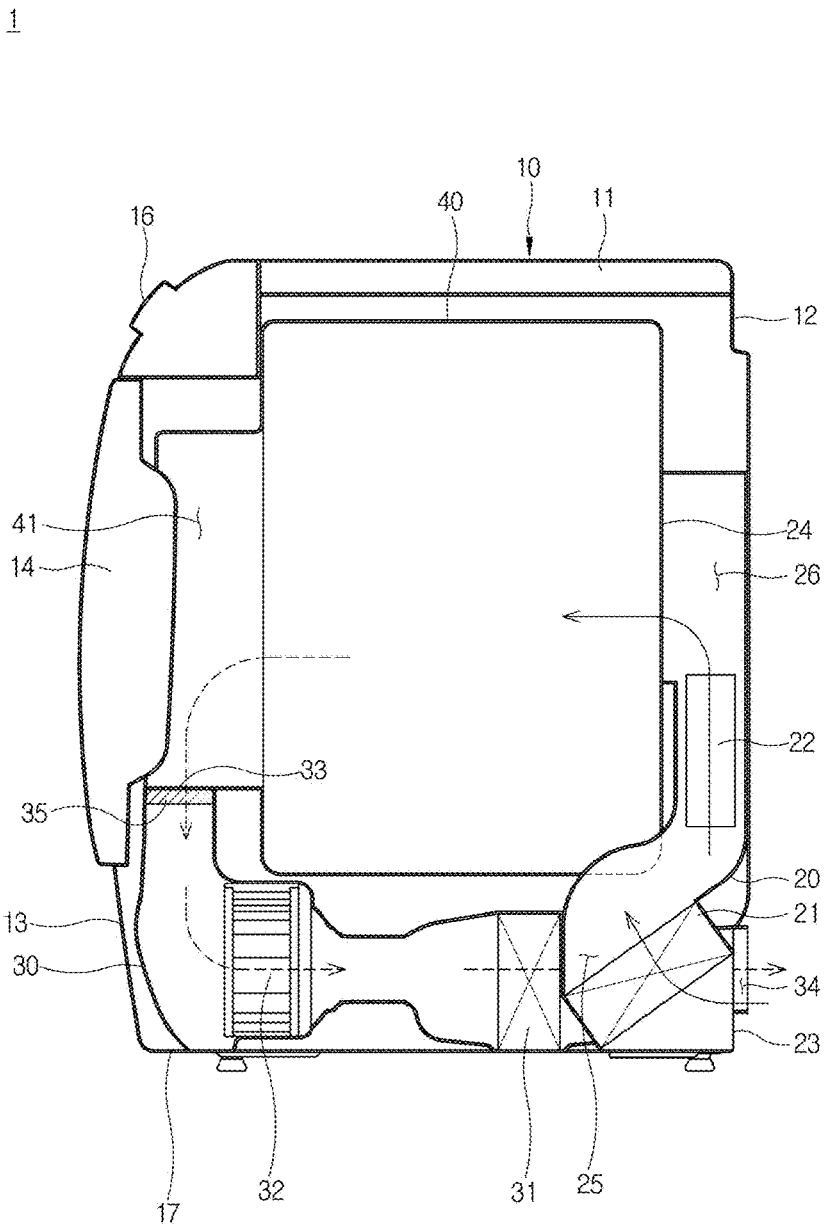
FIG. 3 is a schematic side cross-sectional view illustrating the dryer of FIG. 2.
Figure 4:
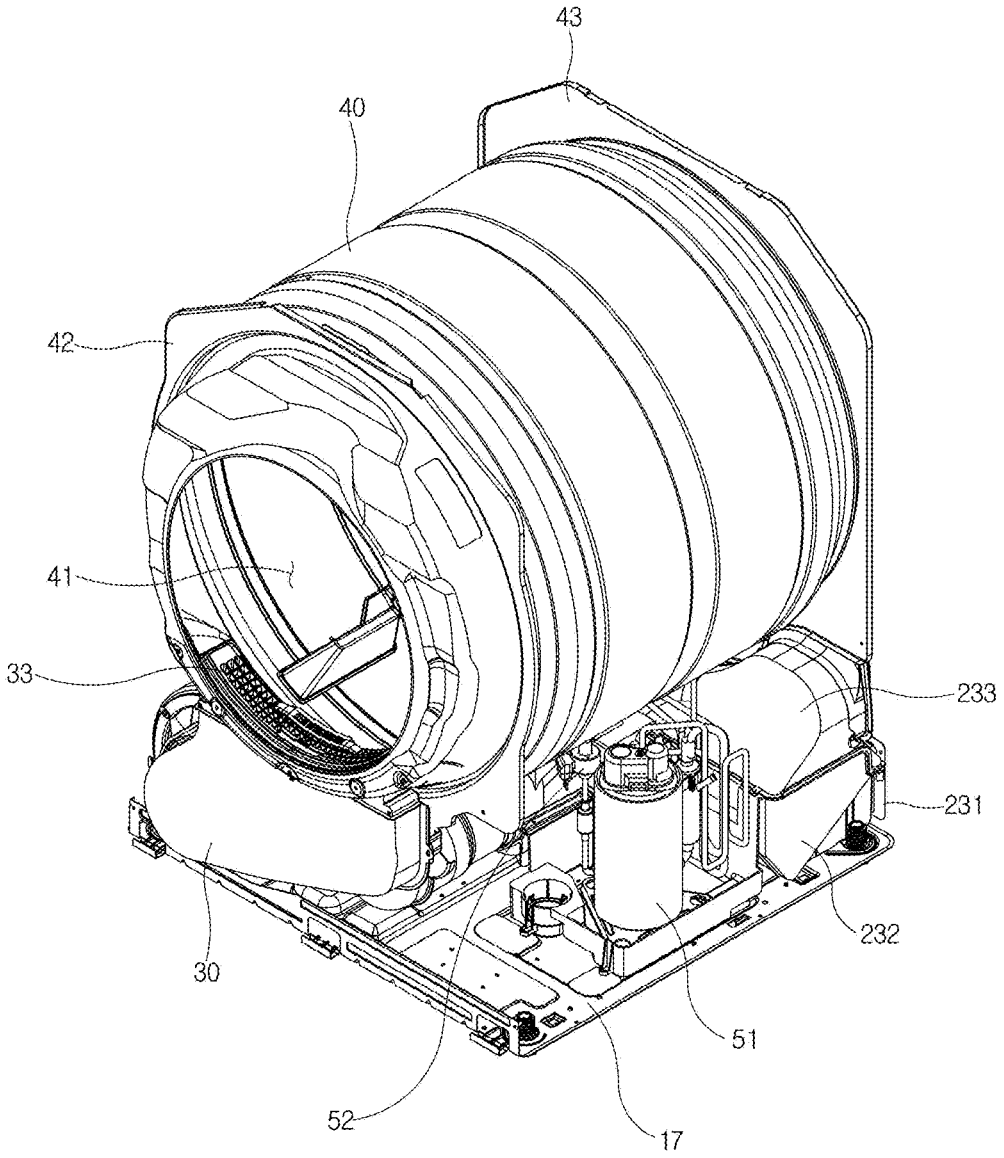
FIG. 4 is a front perspective view illustrating the dryer of FIG. 2 from which a cover of a main body is removed.
Figure 5:
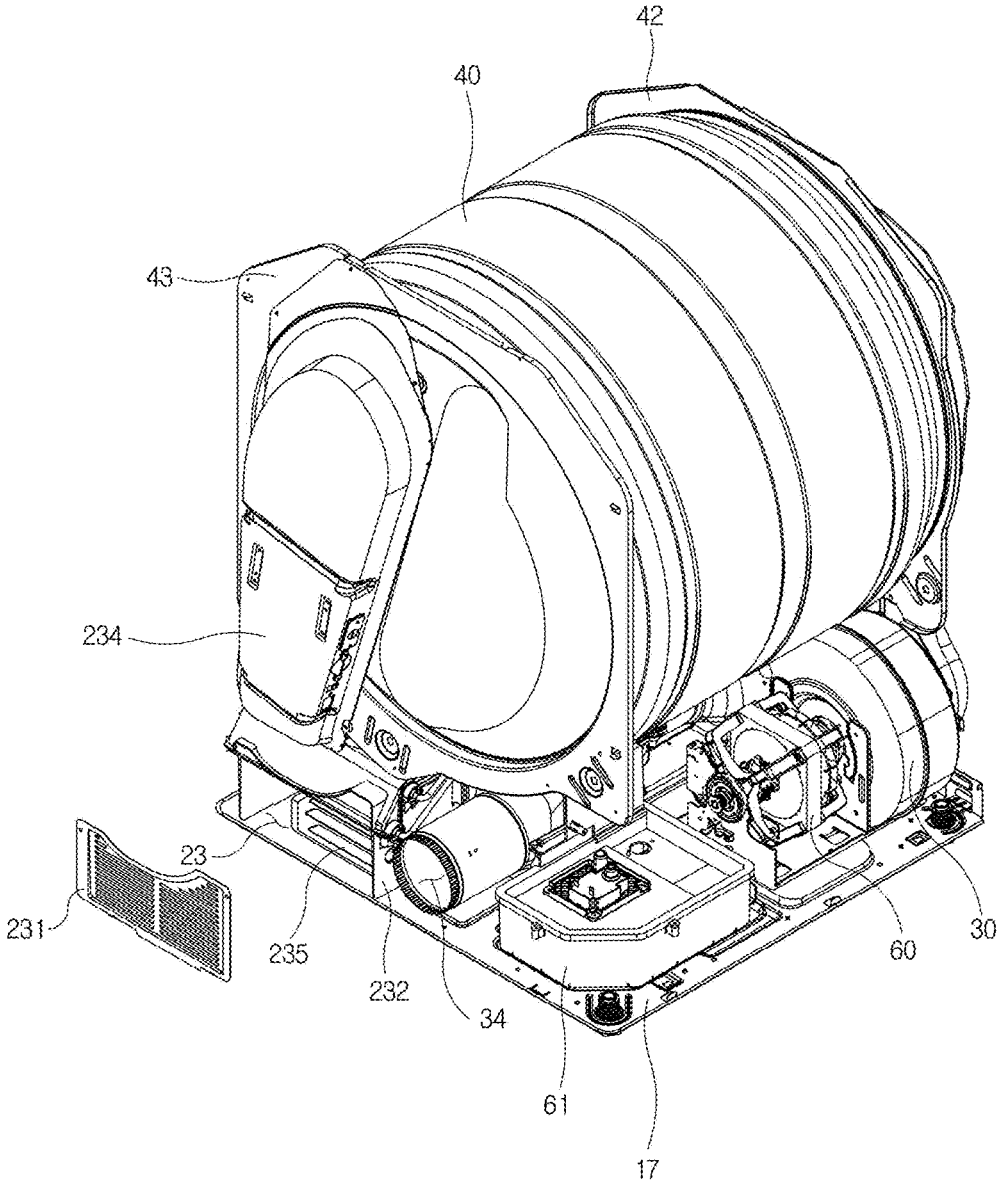
FIG. 5 is a rear perspective view illustrating the dryer of FIG. 2 from which the cover of the main body is removed.

FIG. 3 is a schematic side cross-sectional view illustrating the dryer of FIG. 2. FIG. 3 is the schematic view illustrating a structure below the drum 40 to describe an airflow. FIG. 4 is a front perspective view illustrating the dryer of FIG. 2 from which a cover of the main body is removed, and FIG. 5 is a rear perspective view illustrating the dryer of FIG. 2 from which the cover of the main body is removed.

The dryer 1 according to one embodiment of the present disclosure is a dryer including a heat pump system. Generally, a condensing dryer including a heat pump system in which a refrigerant circuit is formed is a circulating dryer capable of drying an object to be dried by circulating air without discharging or suctioning the air. However, the dryer 1 according to one embodiment of the present disclosure is a discharging dryer configured to suction and use external air and discharge the air to the outside.

First, a refrigerant flow of the heat pump system will be described below. A refrigerant may circulate through a general refrigerant circuit. The refrigerant circuit includes a compressor 51, a condenser 21, an expander 52, and an evaporator 31. The refrigerant may circulate through a series of processes including a compressing process, a condensing process, an expanding process, and an evaporating process. The condenser 21 and the evaporator 31 may be provided as a heat exchanger capable of exchanging heat with the refrigerant.

The compressor 51 compresses a refrigerant gas to a high temperature and pressure state and discharges the refrigerant gas, and the discharged refrigerant gas is introduced into the condenser 21. The condenser 21 may condense the compressed refrigerant into a liquid phase and radiate heat to the outside via the condensing process.

The expander 52 expends the high temperature and pressure liquid phase refrigerant condensed by the condenser 21 into a low pressure liquid phase refrigerant. The evaporator 31 evaporates the refrigerant expended by the expander 52 and returns it to the compressor 51 as a low temperature and pressure refrigerant gas. The evaporator 31 may absorb heat from its surroundings through the evaporating process in which the liquid refrigerant is changed to the gas refrigerant.

Arrows in FIG. 3 denote airflows, and solid arrows show an airflow supplied to the drum 40. External air of the main body 10 flows into the air supply unit 20 via the suction port 23. The air flowing into the air supply unit 20 may pass through the condenser 21 during the suction process. A temperature of low temperature dry external air is increased while the external air passes through the condenser 21. That is, low temperature dry external air of the main body 10 is changed into hot dry air while passing through the condenser 21.

The hot dry air may flow into the drum 40 and dry an object to be dried. The air which absorbs moisture from the object to be dried includes much moisture.

Dotted arrows denote an airflow discharged from the drum 40, high temperature moist air discharged from the drum 40 may pass through the evaporator 31 disposed in a discharge unit 30. A temperature of air of which heat is absorbed by the evaporator 31 is decreased while the air passes through the evaporator 31 and an amount of moisture included in the air is decreased. That is, the high temperature moist air discharged from the drum 40 is changed to low temperature dry air while passing through the evaporator 31. The low temperature dry air passing through the evaporator 31 is discharged to the outside of the dryer 1 via the discharge port 34.

Suctioning and discharging air is performed by a discharge fan 32 disposed in the discharge unit 30. Air discharged from the drum 40 to the discharge unit 30 may include various materials such as lint generated during a drying process and may be discharged after being purified by a filter 35 provided at an entrance of the discharge unit 30. Since the air supply unit 20 is completely isolated from an inside of the main body 10 such that air in the main body 10 is not introduced into the air supply unit 20, the foreign material accumulated in the main body 10 is not suctioned into the air supply unit 20, and the air supply unit 20 suctions only external air of the main body 10, uses the air for drying, and discharges the air to the outside of the main body 10 via the discharge unit 30.

While the high temperature moist air discharged from the drum 40 is cooled in the evaporator 31 and moisture is discharged therefrom, condensate may be generated. The condensate drops from the evaporator 31 and is collected in a water container (not shown) provided below the evaporator 31. The condensate collected in the water container (not shown) may be moved to a storage 61 or drained to the outside of the main body 10.

An internal configuration of the dryer 1 will be described in detail below with reference to FIGS. 4 and 5. The drum 40 is formed in a cylindrical shape having a horizontally defined rotational center. A front panel 42 in which an inlet 41 through which an object to be dried is input into the drum 40 is disposed on a front surface of the drum 40, and a rear surface of the drum 40 is closed by a rear panel 43 connected to the suction port 23 of the air supply unit 20.

In addition, an outlet 33 for discharging air used for drying the object is provided in the front panel 42 of the drum 40. A filter 35 configured to collect a foreign material generated by the object to be dried is installed in the outlet 33. Accordingly, the drum 40 is formed such that the foreign material generated by the object may be collected via the filter 35, and the collected foreign material may be withdrawn to the outside.

The drum 40 is connected to a drum rotating motor (not shown) disposed in the main body 10. Accordingly, in the case in which the dryer is operated, the drum 40 is rotated at a set speed by the drum rotating motor.

Figure 6:
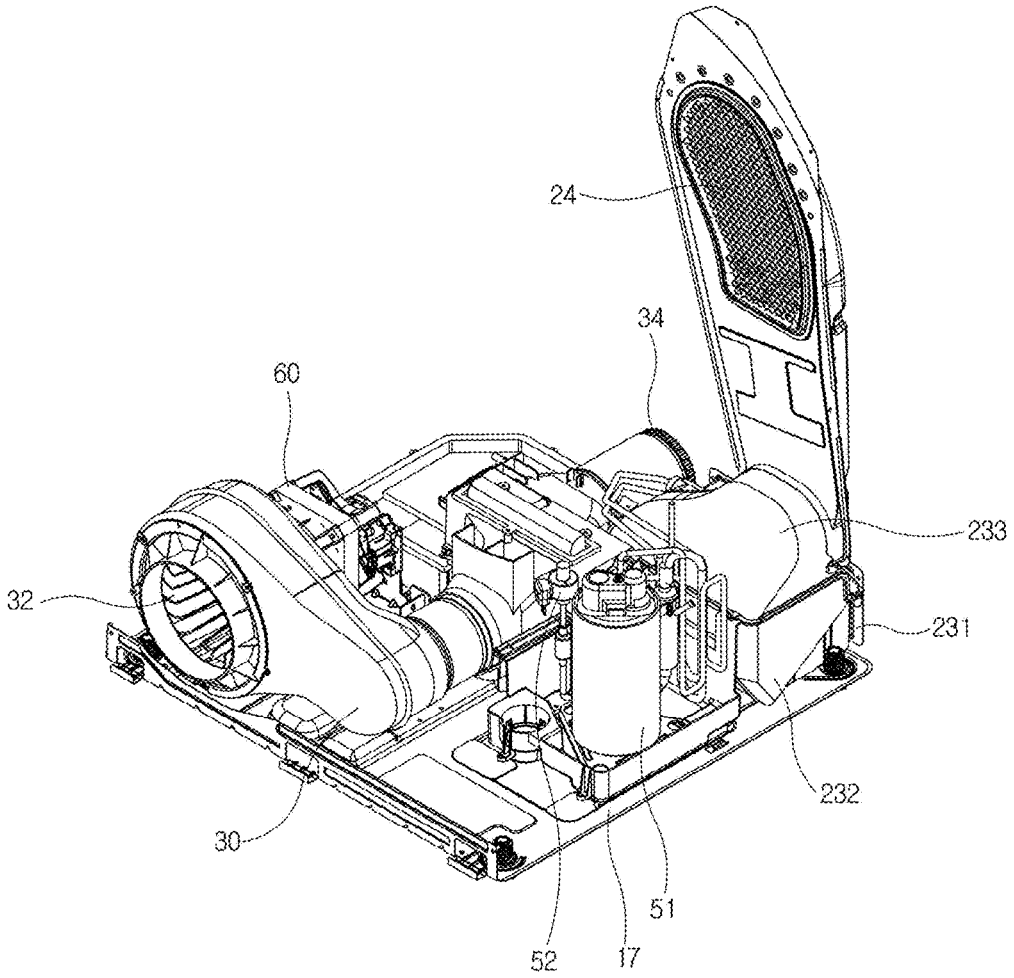
FIG. 6 is a view illustrating the dryer of FIG. 4 from which a drum is removed.
Figure 7:
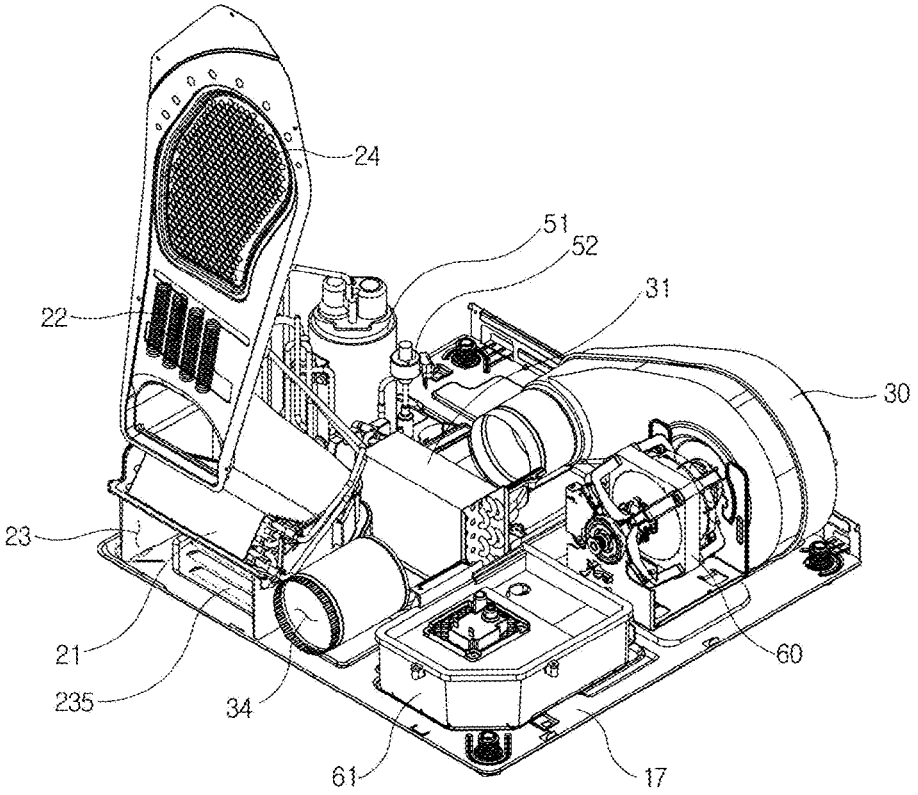
FIG. 7 is a view illustrating an exposed air supply unit and an exposed discharge unit of a heat exchanger of the dryer of FIG. 5.

FIG. 6 is a view illustrating the dryer of FIG. 4 from which the drum is removed, and FIG. 7 is a view illustrating an exposed air supply unit and an exposed discharge unit of the heat exchanger of the dryer of FIG. 5.

Referring to FIGS. 4 to 7, the main body 10 may include the air supply unit 20 configured to supply air introduced from the outside of the main body to the drum 40, and the discharge unit 30 configured to suction air from the drum and discharge the air to the outside of the main body 10.

In addition, the main body 10 may include a heat pump system configured to exchange heat with air passing through the air supply unit 20, the drum 40, and the discharge unit 30, and the compressor 51, the condenser 21, the evaporator 31, and the like forming the heat pump system may be seated on a base plate 17 of the main body 10. The discharge fan 32, the motor 60, and the like as well as the heat pump system may be seated on the base plate 17 of the main body 10.

The condenser 21 may be disposed at the air supply unit 20 to heat air introduced from the outside of the main body 10 and supply the heated air to the drum 40, and the air supply unit 20 is formed such that the inside of the air supply unit 20 is isolated from the inside of the main body 10 by a housing coupled to the base plate 17 of the main body 10 such that air in the main body 10 is not introduced into the air supply unit 20. Specifically, the housing may include a side housing 232 coupled to the base plate 17 and a top housing 233 configured to cover the side housing 232. An air supply duct 234 is disposed above the top housing 233, and the base plate 17, the side housing 232, the top housing 233, and the air supply duct 234 are coupled airtightly.

The housing may be disposed to be adjacent to a side or rear surface of the main body 10, and the suction port 23 may be provided in the rear surface of the main body 10 and one surface of the housing coupled to the rear surface. The suction port cover 231 may be detachably coupled to the suction port 23, and, in the case in which a foreign material is introduced into the suction port 23, the suction port cover 231 may be separated from the suction port 23 and the inside of the suction port 23 may be cleaned. In addition, an additional suction port 235 may be provided in the base plate 17 divided by the side housing 232.

In addition, the housing may include an air supply port 24 provided in the one surface of the housing coupled to the rear surface of the drum 40. Specifically, the air supply port 24 may be provided in a surface of the air supply duct 234 disposed behind the drum 40 and connected to the rear surface of the drum 40. The drum 40 is airtightly connected to the air supply duct 234.

Referring to FIG. 3, the air supply unit 20 may include a suction area 25 through which air is introduced from the outside of the main body 10 and an air supply area 26 configured to supply the air to the drum 40, the suction area 25 may be disposed below the drum, and the air supply area 26 may be disposed behind the drum 40.

The suction area 25 may be divided by the base plate 17, the side housing 232, and the top housing 233, and the air supply area 26 may be divided by the air supply duct 234. Specifically, the condenser 21 disposed in the air supply unit 20 may be disposed in the suction area 25 of the air supply unit 20. Since the condenser 21 is disposed in the suction area 25 formed below the drum 40, the condenser 21 is not seriously affected by a space limitation, and thus the condenser 21 having a required size and performance may be disposed in the suction area 25.

Air flowing into the suction area 25 is heated while passing through the condenser 21, and the air supply unit 20 may further include a heater 22 to further heat the air heated by the condenser 21. The heater 22 may include an electric heater having a heating coil. In addition, the heater 22 may be disposed in the air supply duct 234 of the air supply unit 20, that is, in the air supply area 26.

Referring to FIGS. 4 to 7, the discharge unit 30 extends vertically at a front portion of the main body 10 and is airtightly connected to the air outlet 33 of the drum 40. In addition, the discharge unit 30 extends at a lower portion of the main body 10, that is, extends laterally below the drum 40, and the discharge port 34 is formed at a rear end of the discharge unit 30.

The discharge fan 32 by which air is suctioned into and discharged from the drum 40 is installed in the discharge unit 30, and high temperature moist air suctioned from the drum 40 by the discharge fan 32 is cooled and dehumidified while passing through the evaporator 31 disposed in the discharge unit 30, and is then discharged through the discharge port 34. The discharge fan 32 may include a centrifugation type blast apparatus such as a sirocco fan.

Figure 8:
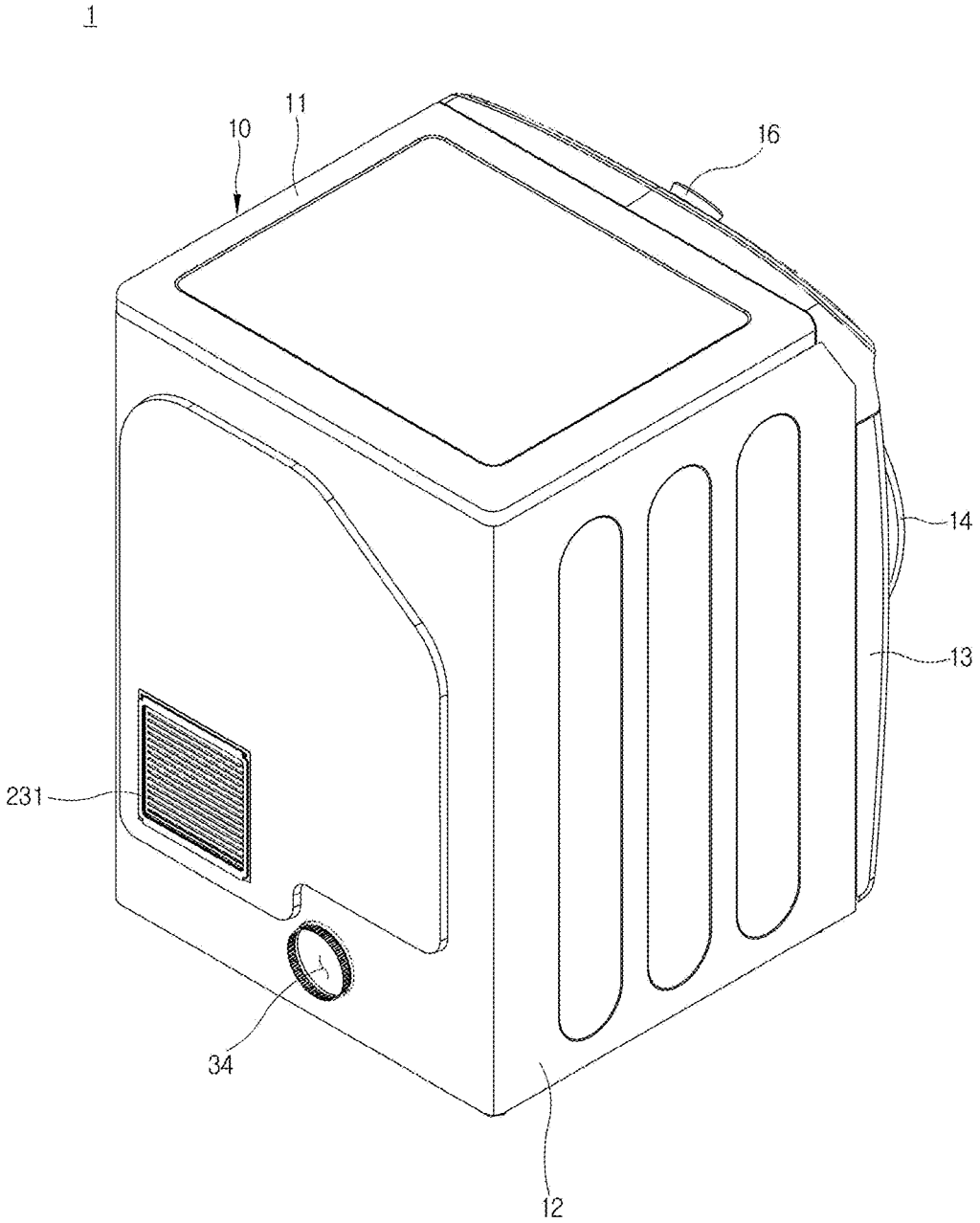
FIG. 8 is a perspective view illustrating a rear exterior of a dryer according to another embodiment of the present disclosure.
Figure 9:
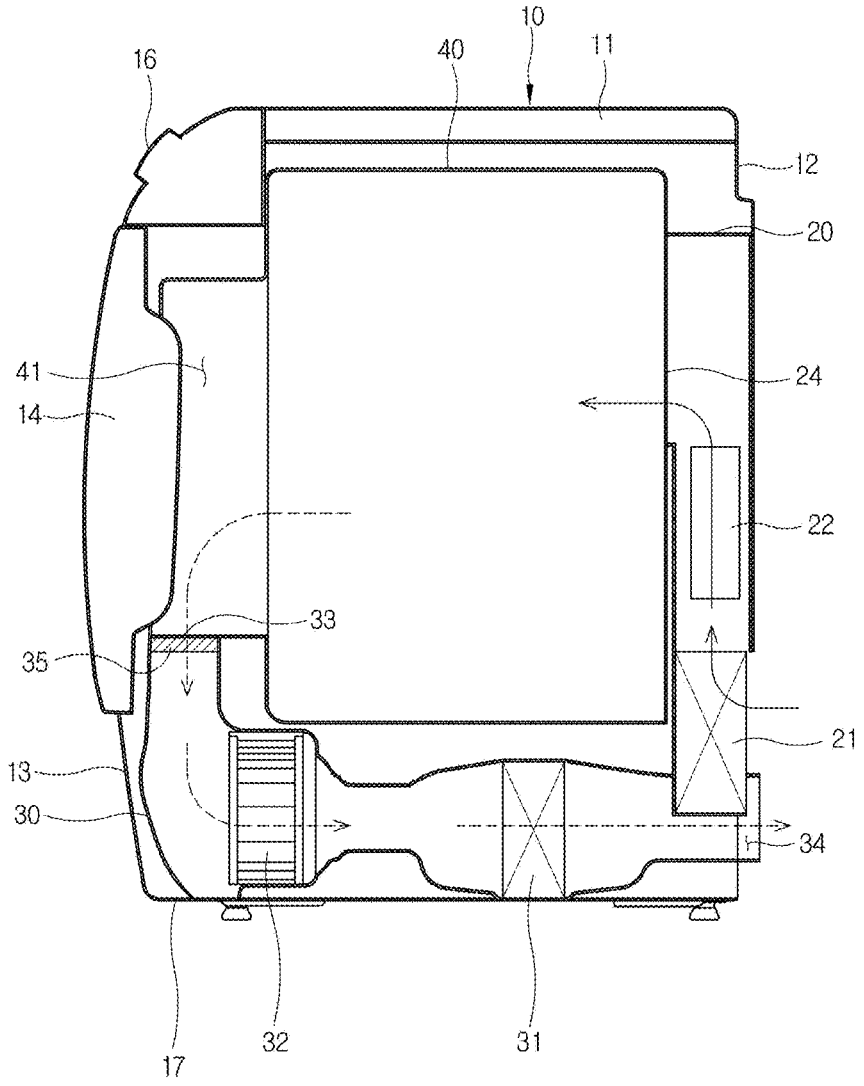
FIG. 9 is a schematic side cross-sectional view illustrating the dryer of FIG. 8.
Figure 10:
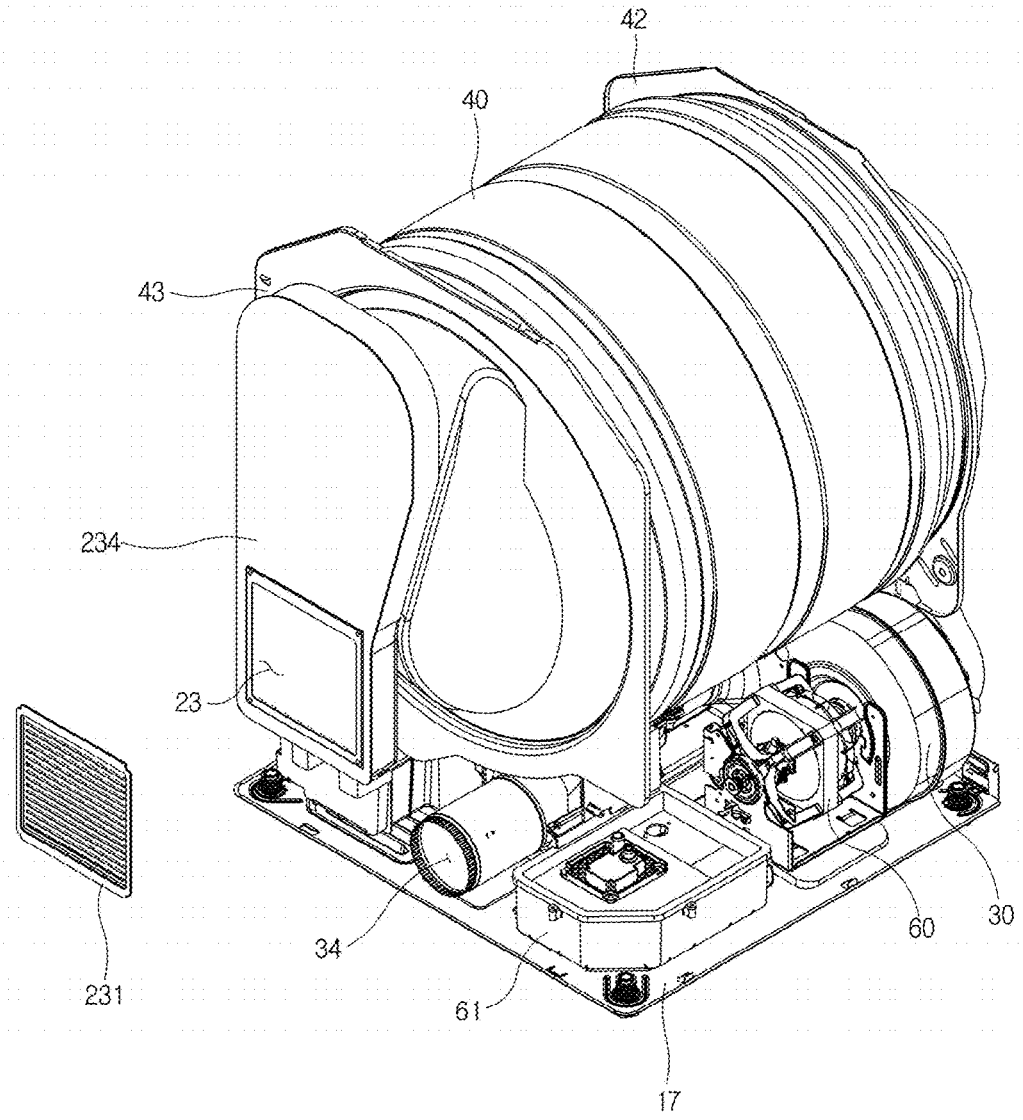
FIG. 10 is a rear perspective view illustrating the dryer of FIG. 8 from which a cover of a main body is removed.

FIG. 8 is a perspective view illustrating a rear exterior of a dryer according to another embodiment of the present disclosure, and FIG. 9 is a schematic side cross-sectional view illustrating the dryer of FIG. 8. FIG. 9 is a schematic view illustrating a structure below the drum 40 to show an airflow. FIG. 10 is a rear perspective view illustrating the dryer of FIG. 8 from which a cover of a main body is removed, and FIG. 11 is a view illustrating an exposed air supply unit and an exposed discharge unit of a heat exchanger of the dryer of FIG. 10.

The dryer illustrated in FIGS. 8 to 11 is the same as that illustrated in FIGS. 2 to 7 except a shape and a location of an air supply unit 20. Accordingly, components which are the same as those of the embodiment illustrated in FIGS. 2 to 7 may be not described.

Referring to FIG. 8, a suction port 23 capable of suctioning air for drying and a discharge port 34 capable of discharging air used in drying may be provided in a rear surface of a dryer 1. A suction port cover 231 may be detachably provided on the suction port 23. In a case in which a foreign material is suctioned into the suction port 23, the suction port cover 231 may be separated from the suction port 23 and an inside of the suction port 23 may be cleaned.

Figure 11:
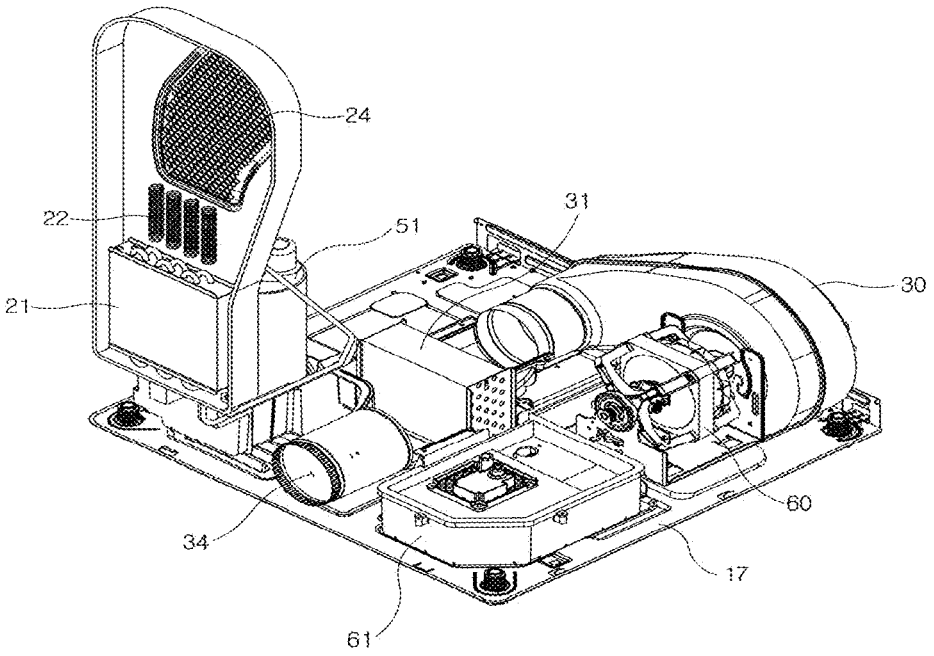
FIG. 11 is a view illustrating an exposed air supply unit and an exposed discharge unit of a heat exchanger of the dryer of FIG. 10.

Referring to FIGS. 9 to 11, a main body 10 may include the air supply unit 20 configured to supply air introduced from the outside of the main body 10 to the drum 40, and a discharge unit 30 configured to suction air from the drum and discharge the air to the outside of the main body 10.

A condenser 21 may be disposed in the air supply unit 20 to heat air introduced from the outside of the main body 10 and supply the air to the drum 40, and the air supply unit 20 is formed such that an inside of the air supply unit 20 is isolated from an inside of the main body 10 by a housing disposed behind the drum 40, such that air in the main body 10 is not introduced into the air supply unit 20. Specifically, the housing may be disposed as the air supply duct 234, and may be disposed adjacent to a side or rear surface of the main body 10. The suction port 23 may be provided in the rear surface of the main body 10, and one surface of the housing connected to the rear surface. The suction port cover 231 may be detachably coupled to the suction port 23, and in the case in which a foreign material is introduced into the suction port 23, the suction port cover 231 may be separated from the suction port 23 and the inside of the suction port 23 may be cleaned.

In addition, the housing may include an air supply port 24 provided in one surface of the housing coupled to a rear surface of the drum 40. Specifically, the air supply port 24 may be provided in a surface of the air supply duct 234 disposed behind the drum 40 and connected to the rear surface of the drum 40. The drum 40 is airtightly connected to the air supply duct 234.

Air flowing into a suction area 25 is heated while passing through the condenser 21, and the air supply unit 20 may further include a heater 22 to further heat the air heated by the condenser 21. The heater 22 may include an electric heater having a heating coil.

The scope of the present disclosure is not limited to the above-described specific embodiments. Various other embodiments that may be changed or modified by those skilled in the art without departing from the scope and spirit of the present disclosure defined by the appended claims fall within the scope of the present disclosure.

The invention claimed is:

1. A dryer comprising:

a main body;

a drum installed in the main body;

a housing configured to accommodate a condenser such that the condenser is isolated from an inside of the main body and comprising a suction port provided in a rear surface of the main body or one surface of the housing connected to the rear surface to suction outside air into an air supply unit, and a suction port cover detachably coupled to the suction port to prevent foreign substance from being suctioned into the suction port;

the air supply unit configured to supply the air introduced from an outside of the main body through a suction area into the drum;

a discharge unit configured to suction the air from the drum and discharge the air to the outside of the main body, the discharge unit including a discharge fan; and a heat pump system configured to exchange heat with the air passing through the air supply unit, the drum, and the discharge unit, the heat pump system comprising:

the condenser disposed within the air supply unit and configured to heat the air passing through the air supply unit, and an evaporator disposed within the discharge unit and configured to cool the air passing through the discharge unit, wherein the evaporator is disposed on a downstream side of the discharge fan within the discharge unit, wherein the air supply unit is isolated from the inside of the main body such that air in the main body is not introduced into the air supply unit, and wherein the suction area encompasses the condenser.

2. The dryer of claim 1, wherein the heat pump system further includes an expander and a compressor.

3. The dryer of claim 2, wherein:

the air supply unit further includes an air supply area configured to supply the air to the drum;

the suction area is disposed below the drum; and the air supply area is disposed behind the drum.

4. The dryer of claim 3, wherein:

the suction area includes the suction port provided in at least one among the rear surface, a side surface, or a lower surface of the main body; and the air supply area includes an air supply port connected to a rear surface of the drum.

5. The dryer of claim 3, wherein the air supply unit further includes a heater configured to further heat the air passing through the condenser.

6. The dryer of claim 5, wherein the heater is disposed in the air supply area of the air supply unit.

7. The dryer of claim 1, wherein the discharge unit further includes a discharge port through which the air passing through the evaporator is discharged to the outside of the main body.

8. The dryer of claim 1, wherein:

the air supply unit is disposed behind the drum; and the discharge unit is disposed below the drum.

9. The dryer of claim 8, wherein the air supply unit includes:

the suction port connected to the rear surface or a side surface of the main body; and an air supply port connected to a rear surface of the drum.

10. The dryer of claim 1, further comprising:

a base plate provided at the main body, wherein the condenser is seated on the base plate; and a compressor and an expander configured to form a refrigerant circuit together with the condenser and the evaporator, wherein the housing coupled to the base plate.

11. The dryer of claim 10, wherein the housing is disposed adjacent to a side surface or the rear surface of the main body.

12. The dryer of claim 11, further comprising an additional suction port provided on the base plate divided by the housing.

13. The dryer of claim 11, wherein the housing includes an air supply port provided at one surface of the housing connected to a rear surface of the drum.

14. The dryer of claim 10, further comprising an additional suction port provided on the base plate divided by the housing.

15. The dryer of claim 10, wherein the housing includes an air supply port provided at one surface of the housing connected to a rear surface of the drum.

16. The dryer of claim 1, wherein:

the air supply unit further includes an air supply area configured to supply the air to the drum;

the suction area is disposed below the drum; and the air supply area is disposed behind the drum.

17. The dryer of claim 16, wherein:

the suction area includes the suction port provided in at least one among the rear surface, a side surface, or a lower surface of the main body; and the air supply area includes an air supply port connected to a rear surface of the drum.

18. The dryer of claim 1, wherein the air supply unit includes:

the suction port connected to the rear surface or a side surface of the main body; and an air supply port connected to a rear surface of the drum.

* * * * *